US006095872A

United States Patent [19]

Lang et al.

[11] Patent Number: 6,095,872

[45] Date of Patent: Aug. 1, 2000

[54] CONNECTOR HAVING TERMINALS WITH IMPROVED SOLDIER TAILS

[75] Inventors: Harold Keith Lang, Fox River Grove; Augusto P. Panella, Naperville; Irvin R. Triner, Willow Springs; Alan S. Walse, LaGrange, all of Ill.

[73] Assignee: Molex Incorporated, Lisle, Ill.

[21] Appl. No.: 09/176,033

[22] Filed: Oct. 21, 1998

[51] Int. Cl.[7] ..... H01R 13/40

[52] U.S. Cl. ..... 439/733.1

[58] Field of Search ..... 439/733.1, 60, 439/630–637; 361/774, 773; 257/692

[56] References Cited

U.S. PATENT DOCUMENTS

| | | | |
|---|---|---|---|
| 3,399,372 | 8/1968 | Uberbacher | 339/17 |
| 4,217,024 | 8/1980 | Aldridge et al. | 339/275 T |
| 4,339,784 | 7/1982 | Shearer | 361/403 |
| 4,638,116 | 1/1987 | Gumb | 174/68.5 |
| 4,805,830 | 2/1989 | Kawaguchi | 228/179 |
| 4,918,277 | 4/1990 | Zimmer | 219/56.1 |
| 5,076,804 | 12/1991 | Bertho et al. | 439/567 |
| 5,120,257 | 6/1992 | Hahn | 439/567 |
| 5,129,573 | 7/1992 | Duffey | 228/180.1 |
| 5,238,413 | 8/1993 | McCaffrey et al. | 439/79 |
| 5,259,768 | 11/1993 | Brunker et al. | 439/60 |
| 5,259,793 | 11/1993 | Yamada et al. | 439/637 |
| 5,409,399 | 4/1995 | Geoghegan et al. | 439/567 |
| 5,411,404 | 5/1995 | Korsunsky et al. | 439/108 |
| 5,462,444 | 10/1995 | Korsunsky et al. | 439/108 |
| 5,517,162 | 5/1996 | Ariyoshi | 333/222 |
| 5,604,333 | 2/1997 | Kennish et al. | 174/261 |
| 5,654,878 | 8/1997 | Sasao et al. | 361/773 |
| 5,679,929 | 10/1997 | Greenfield et al. | 174/261 |
| 5,735,696 | 4/1998 | Niitsu et al. | 439/65 |
| 5,941,715 | 8/1999 | Huang | 439/60 |

FOREIGN PATENT DOCUMENTS

| | | | |
|---|---|---|---|
| 60-164345 | 8/1985 | Japan | H01L 23/48 |

*Primary Examiner*—Khiem Nguyen
*Assistant Examiner*—J. F. Duverne
*Attorney, Agent, or Firm*—Robert J. Zeitler; Charles S. Cohen

[57] ABSTRACT

Provided is an electrical connector for connecting a first electrical component to a circuit member having generally oppositely facing mating and remote surfaces and conductive regions on at least one of the mating and remote surfaces, at least one of the conductive regions being a through hole. The connector includes a dielectric housing having a receiving area for receiving the first electrical component therein and a plurality of terminal receiving cavities extending generally perpendicularly to at least one of the surfaces. The connector further includes a terminal in one of the terminal receiving cavities. The terminal has a body portion, a contact arm extending from the body portion for electrically contacting the first electrical component, a retention portion for retaining the terminal in the cavity, and a board contact extending from the body portion to the through hole. The board contact is a through hole-type tail for extending through the through hole. The tail includes a full segment and an abutting narrowed segment, each segment having edges and a centerline generally perpendicular to the mating surface, the centerline of the narrowed segment being offset from the centerline of the full segment. A transition between the abutting segments is positioned between the mating and remote surfaces of the circuit member when the connector is mounted to the circuit member.

21 Claims, 4 Drawing Sheets

CONNECTOR HAVING TERMINALS WITH IMPROVED SOLDIER TAILS

BACKGROUND OF THE INVENTION

The present invention relates to electrical connectors for mounting to printed circuit boards, and more particularly to an improved connector having terminals with improved solder tails.

Devices such as computers using printed circuit boards are exhibiting increasing circuit densities and are operating at increasing frequencies. For example, the speeds of high frequency digital signals traveling between a computer motherboard and densely populated memory module printed circuit cards on an associated circuit board are becoming higher.

These trends create problems for electrical connectors such as edge card connectors that are used to removably mount a circuit card on a circuit board. With increasing circuit density, the electrical connectors and the electrical terminals they include are smaller and closer together. The terminals must nevertheless be sufficiently flexible and strong to provide reliable contact with a circuit card inserted into the connector. In addition, it is desirable to keep small the impedance of the circuit paths provided by the electrical terminals of the edge card connector. Meanwhile, inductance must be kept to a minimum, capacitance must be carefully controlled, and crosstalk between different signals must be minimized.

Yet another problem which may arise with increased circuit density is the undesirable bridging of solder from one terminal tail and corresponding through hole to another. Surface tension shapes molten solder into generally circular fillets around where the terminal tail protrudes from a through hole in a circuit board. Where through holes and corresponding tails are disposed particularly close together, the solder fillets formed about those through holes may overlap, thereby providing an undesirable short circuit between the terminal tails. Therefore, it is also desirable to prevent solder bridging to avoid unwanted short circuits and the appearance of inferior quality in the connector-mounted circuit board.

The various and conflicting goals discussed above have led to many approaches for connector and terminal design with varying degrees of success. U.S. Pat. No. 5,161,987, for example, discloses an electrical connector having a ground bus with a plurality of solder tails. A row of signal contacts is located on each side of the ground bus.

U.S. Pat. No. 5,162,002, meanwhile, discloses a card edge connector with spatially overlapped terminals having relatively shorter and relatively longer contact elements. This connector has important advantages such as reducing the peak card insertion force, but has electrical characteristics that are not optimized for higher speed digital signals.

U.S. Pat. No. 5,192,220 discloses a dual readout socket wherein crosstalk is reduced by increasing the space between connectors. This approach defeats the goal of increased circuit density.

U.S. Pat. No. 5,259,768 discloses an electrical connector having ground terminals with significantly larger surface areas than the signal terminals. The ground and signal terminals alternate, and the shadowing effect of the ground terminals reduces crosstalk. The ground terminals have both solder tails and grounding feet to reduce impedance generally, while non-functional stubs are sized to provide a specifically desired impedance.

U.S. Pat. No. 5,259,793 discloses an edge connector with terminals arranged in an alternating array along the circuit card insertion slot. Circuit density is diminished because of the alternating array.

U.S. Pat. No. 5,309,630 discloses an electrical connector wherein a desired impedance is obtained by selecting terminals having anchoring portions sized to correspond to the desired impedance. Signal and ground terminals may alternate, and at least the ground terminals are provided with two feet to reduce impedance. U.S. Pat. No. 5,580,257 discloses a connector in which enlarged ground terminals are adjacent to pairs of signal terminals to reduce crosstalk. Although this arrangement has advantages, three different terminal shapes are required, and the operation of assembling terminals into the connector housing is complex.

U.S. Pat. No. 5,654,878 discloses a terminal tail having a reduced-width portion wherein parallel edges provide dual alignment positioning allowance on opposite sides of the tip of the solder tail for facilitating insertion thereof into a through hole.

U.S. Pat. No. 5,409,399 discloses solder tails having curved sections for providing transverse offset relative to the centerlines of the solder tails.

Despite these and many other attempts, there remains a long-standing need for a card edge connector that can be made at reasonable cost, is robust and reliable, has high circuit density, performs well in high speed digital circuits, and avoids density related problems such as solder bridging.

SUMMARY OF THE INVENTION

An object of the present invention is to provide an improved connector. Other objects are to provide a connector with low inductance that can achieve an impedance match with associated circuit assemblies; to provide a connector having minimum cross talk between signal circuits; to provide a connector having high circuit density; to provide a connector that is robust although small; to provide a mechanically and electrically reliable connector that can be manufactured and assembled inexpensively; to provide a connector having a dense arrangement of board contacts while deterring solder bridging; and to provide an improved connector overcoming disadvantages of connectors used in the past.

In accordance with the invention there is provided an edge card-type electrical connector for connecting a circuit card having opposed surfaces with conductive pads thereon to a circuit board having top and bottom surfaces and conductive regions on at least one of the top and bottom surfaces, at least one of the conductive regions being a through hole.

The connector includes a dielectric housing having a longitudinal slot for receiving the circuit card therein and a plurality of terminal receiving cavities extending perpendicularly to and intersecting the slot. The connector further includes a signal terminal in one of the terminal receiving cavities. The signal terminal has a body portion, a contact arm extending from the body portion for contacting one of the conductive pads on the circuit card, a retention arm extending from the body portion for retaining the terminal in the cavity, and a board contact extending from the body portion to the conductive region of the circuit board. The connector further includes a reference or ground terminal in another of the terminal receiving cavities. The ground terminal has a body portion, a contact arm extending from the body portion for contacting one of the conductive pads on the circuit card, a retention section for retaining the terminal in the cavity, and a board contact extending from the body portion to the conductive region of the circuit board.

One of the board contacts of one of the terminals is a through hole-type tail for extending through the through hole. The tail includes a full segment and an abutting narrowed segment, each segment having edges and a centerline generally perpendicular to the board. The centerline of the narrowed segment is offset from the centerline of the full segment, and the abutting segments abut between the top and bottom surfaces of the board when the tail is extending through the through hole.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 1:
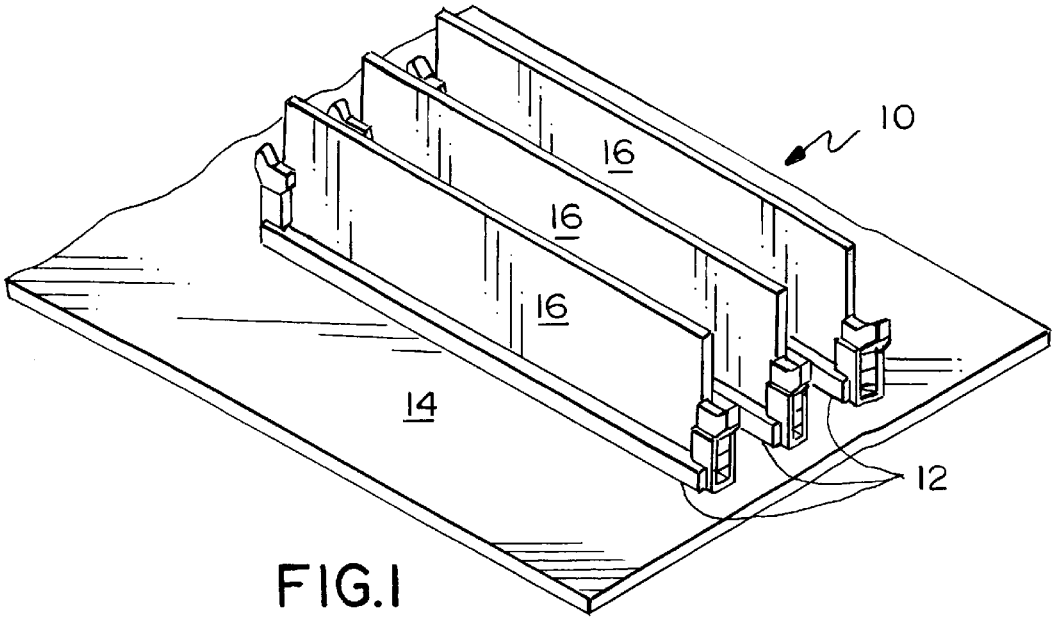
FIG. 1 is an isometric view of a printed circuit board assembly including card edge connectors embodying the present invention mounted on a circuit board and connecting removable circuit cards to the circuit board.

Having references now to the drawings, in FIG. 1 there is illustrated a circuit assembly generally designated as 10 and including three card edge connectors, each generally designated as 12, constructed in accordance with the principles of the present invention. The circuit assembly 10 includes a printed circuit board 14, for example, a computer motherboard. The card edge connectors 12 are mounted on the circuit board 14 and removably receive printed circuit cards 16, for example, memory modules with random access memory available to the motherboard 14. The card edge connector provides circuit paths so that power, ground and digital signals can be transferred between the circuit board 14 and the circuit cards 16.

Figure 7:
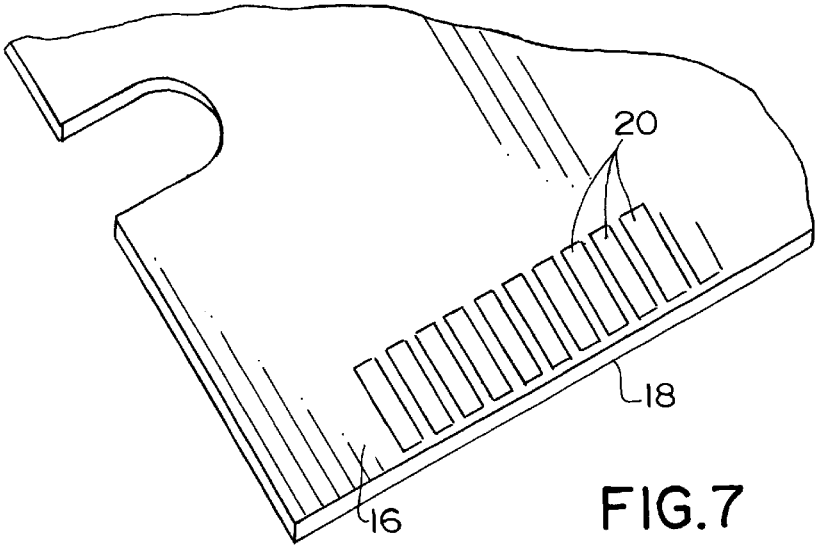
FIG. 7 is a fragmentary isometric view of a circuit card that mates with the card edge connector.
Figure 8:
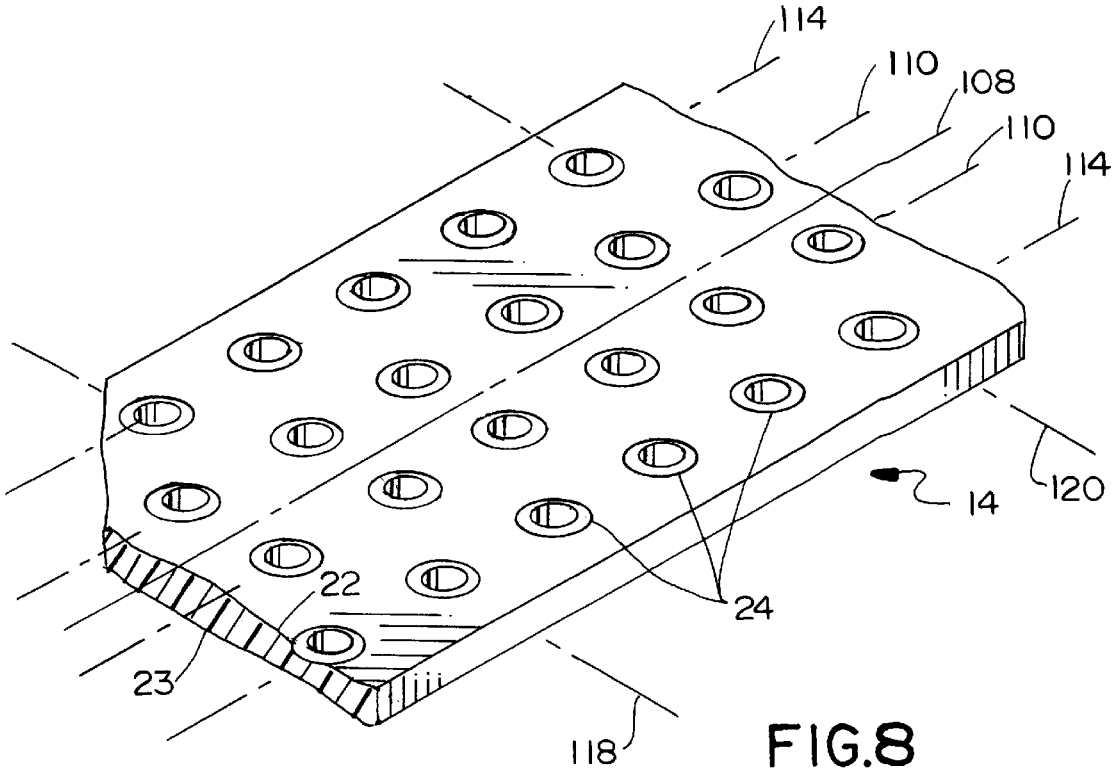
FIG. 8 is a fragmentary isometric view of a portion of a circuit board upon which the card edge connector is mounted, with reference lines added to aid in the description of the invention.

The pertinent structure of the first electrical component, preferably circuit card 16, and the second electrical component, preferably circuit board 14, are shown in preferred embodiments in FIGS. 7 and 8, respectively. The card 16, of which a fragment is seen in FIG. 7, includes a leading or mating edge 18 that mates with the card edge connector 12. A series of conductive contact pads 20 is provided on both opposed surfaces of the card 16 substantially along the mating edge 18. Conductive traces on the card 16 provide power, ground and signal paths leading from the contact pads 20 to components (not shown) that are mounted on the card 16.

Figure 10:
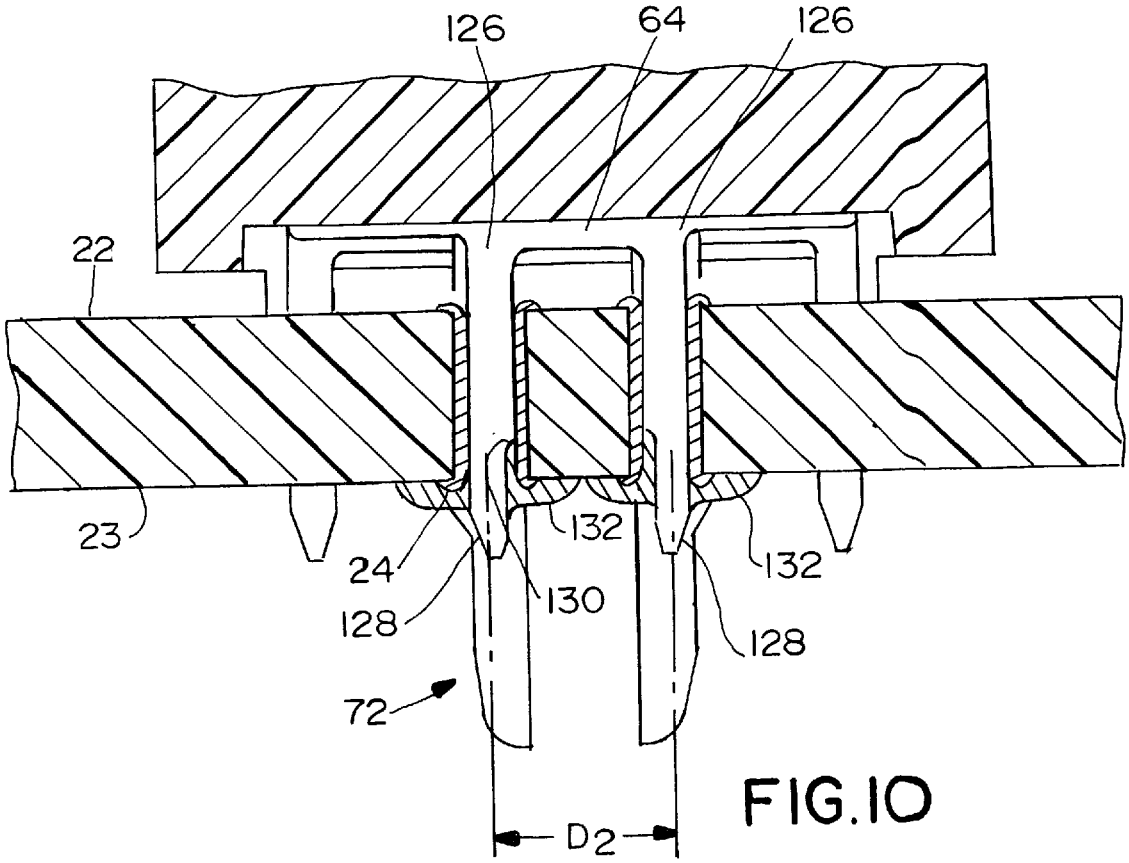
FIG. 10 is a view similar to FIG. 9, but wherein the connector, terminal, and tails are in accordance with an embodiment of the invention and no solder bridging is occurring.

A fragment of the circuit board 14 is shown in FIG. 8. The upper surface 22 (or mating surface) of the board includes an array of conductive regions 24 which preferably extend to the bottom surface 23 (or remote surface) of the board 14. In the illustrated embodiment, the conductive regions 24 are plated through holes (seen in cross-section in FIG. 10). Circuit traces in or on the circuit board 14 provide power, ground and signal paths from the conductive regions 24 to other components (not shown) mounted on the circuit board. When the card edge connector 12 is mounted on the circuit board 14 and when a circuit card 16 is inserted into the card edge connector 12, the connector 12 provides circuit paths between the contact pads 20 and the conductive regions 24.

Figure 3:
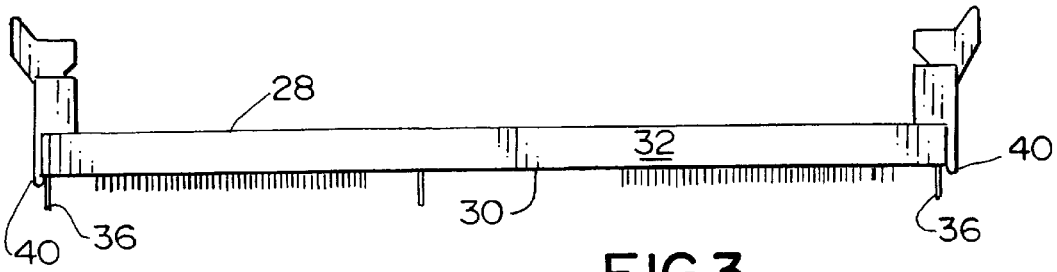
FIG. 3 is a side elevational view of one of the card edge connectors of FIG. 1.
Figure 2:
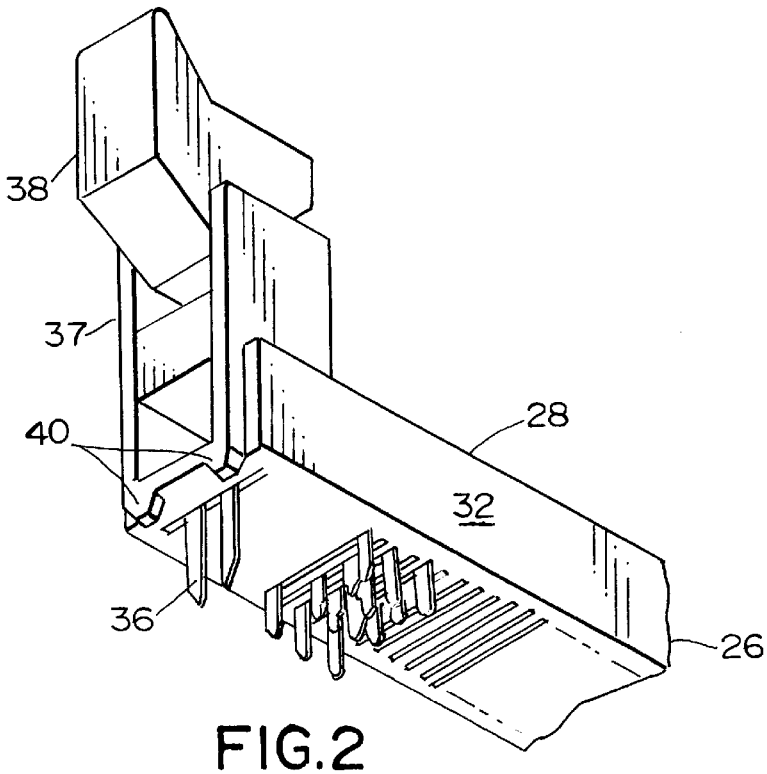
FIG. 2 is a broken isometric view of a connector of FIG. 1 generally illustrating the arrangement of terminal tails extending through the bottom wall of the connector housing.

As seen in FIGS. 2 and 3, the card edge connector 12 includes an elongated housing 26 made of an electrically insulating material such as a molded high temperature thermoplastic, such as liquid crystal polymer plastic. The housing has a top wall 28, a bottom wall 30 and opposed side walls 32. A receiving area, such as elongated card slot 34 (shown in FIGS. 4 and 5) in the top wall 28, receives the first electrical component, in this case the mating edge 18 of an inserted card 16. Housing end posts 37 and latches 38 may be provided at the ends of the housing 26, and hold downs 36 are generally known in the art and may be used to mechanically attach the housing 26 to the circuit board 14. The bottom wall 30 includes stand off projections 40 for maintaining a space between the bottom wall 30 and the top surface 22 (FIG. 1) of the circuit board 14.

Numerous terminal receiving cavities 44 (FIG. 4) and 46 (FIG. 5) are provided in the housing 26. In a preferred embodiment of the invention, there may be over fifty cavities 44 and a similar number of cavities 46. Every cavity 44 is immediately adjacent to a cavity 46, and in the preferred embodiment of the invention, the cavities 44 and 46 alternate in position along of the length of the housing 26.

The cavities 44 and 46 are separated by dielectric separator walls 48 which are integral members of the housing 26 and extend transversely or perpendicular to the slot 34 between the side walls 32. The cavities 44 and 46 intersect and extend to both opposed sides of the slot 34. The bottom of the slot 34 has a stop surface 50 defined in part by the separator walls 48 and by spacers 54 in the cavities 44 and terminal retention walls 56 in the cavities 46. The separator walls 48 are connected across cavities 44 by spacer 54 that extends only slightly downward from the stop surface 50 of slot 34. On the other hand, separator walls 48 are connected across cavities 46 by terminal retention walls 56 that extend downward from the stop surface of slot 34 substantially to the bottom of the housing 26. The side walls of the slot 34 are defined by the inner edges of comb-like upper portions 48*a* of the separator walls 48. The lower portions of the cavities 44 and 46 have opposed internal side walls 58. Each cavity 44 and 46 has an open bottom through which terminals may be inserted into the cavities.

Reference terminals 60 are mounted in the cavities 44. The reference terminals generally provide ground or power connections between the circuit board 14 and the circuit card 16. Signal terminals 62 are mounted in the cavities 46. The signal terminals generally provide a circuit path for the transmission of alternating current, digital or other signals, typically high speed digital signals, between the circuit board 14 and the circuit card 16.

In the preferred embodiment, the reference terminals 60 are all identical to one another and the signal terminals 62 are all identical to one another. The terminals 60 and 62 are flat, planar bodies of metal of uniform thickness, preferably made by stamping from metal sheet stock without any other forming or bending operations. This provides a more efficient manufacturing operation and a sturdier and more reliable terminal in comparison with electrical connectors having terminals that are both stamped and formed. Preferably the terminals 60 and 62 are stamped of phosphor bronze and plated with tin and lead over nickel, with selective gold plating at electrical contact areas, though other alloys or conductive materials may be used.

Figure 4:
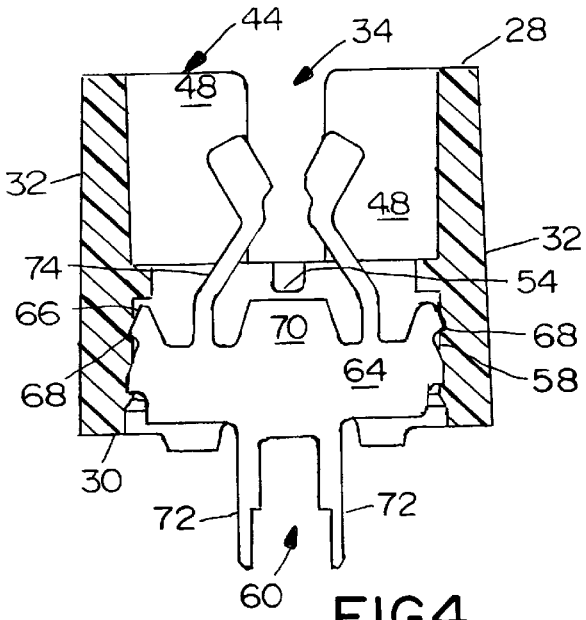
FIG. 4 is an enlarged vertical sectional view of the card edge connector illustrating a reference terminal mounted in a terminal receiving cavity.

In FIG. 4, one of the reference terminals 60 is seen in place in one of the cavities 44. The terminal 60 of the illustrated embodiment (also partially seen in FIG. 6) includes a generally rectangular, planar, plate like body 64 having upwardly extending retention arms 66 at both ends. The arms 66 have barbs 68 that engage the internal side walls 58 and resist removal of the terminal 60 after the terminal 60 is loaded into the cavity 44 through the bottom wall 30. The reference terminal 60 extends across the full width of the cavity 44 and extends to both sides of the slot 34. Other means for retention of the terminal 60, including ones lacking separate arms, are contemplated within the invention.

A pair of spaced apart board contacts 72 extend downward from the body 64. These contacts are received in the plated through hole conductive regions 24 of the circuit board 14 to connect the terminal 60 to the circuit board. The use of two spaced board contacts for the single reference terminal 60 results in parallel redundant circuit paths and low inductance.

A pair of opposed spring arms 74 extend upward from the body 64. Each spring arm 74 includes a flexible beam with a vertical portion 76 and an inwardly sloped portion 78. The end of the spring arm 74 includes a large segment 80 defining a lead-in surface 82 and a contact region 84. When the mating edge 18 of the circuit card 16 is inserted into the slot 34, an opposed pair of conductive pads 20 enter into each of the cavities 44. The mating edge 18 engages the opposed lead in surfaces 82 and the spring arms 74 resiliently deflect or separate. When the card 16 is fully inserted, the contact regions 84 engage the pads 20 to complete circuit paths from the terminal 60 to the opposed pair of pads 20. As such, redundant paths are provided between the circuit board 14 and the circuit card 16.

Figure 5:
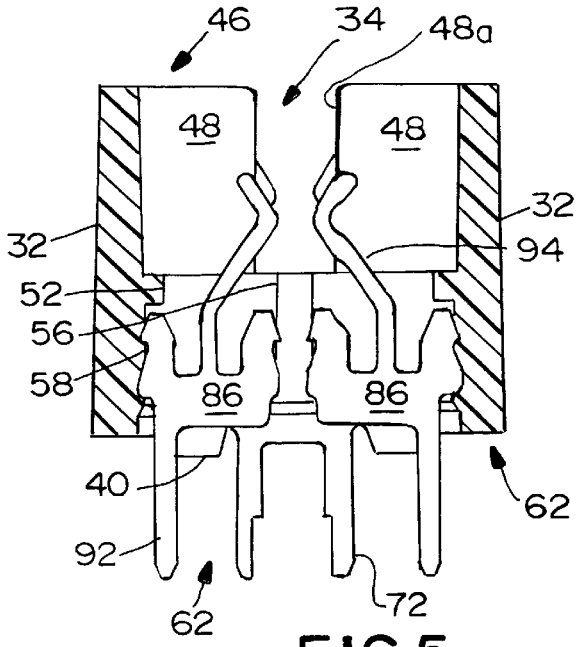
FIG. 5 is a view similar to FIG. 4 illustrating signal terminals mounted in a terminal receiving cavity.

Referring now to FIG. 5, a spaced apart pair of the signal terminals 62 (also seen in FIG. 6) are mounted in each of the cavities 46. The use of pairs of discrete signal terminals 62 rather than a single terminal such as reference terminal 60 permits a high circuit density. Each signal terminal 62 includes a generally rectangular, planar, plate like body 86 having upwardly extending retention arms 88 at both ends. The arms 88 have barbs 90 that retain the terminals 62 in the cavity 46. At the outer ends of the bodies 86, the arms 88 and barbs 90 engage the internal side walls 58. At the inner ends of the bodies 86, the arms 88 and barbs 90 engage opposite sides of the retention wall 56. As with the reference terminal, means for retention of the signal terminal within the cavity other than retention arms are considered to be within the scope of the invention.

A board contact 92 extends downward from the body 86 of each of the terminals 62 in the cavity 46. These contacts 92 are received in the plated through conductive regions 24 of the circuit board 14 to connect the terminals 62 to the circuit board 14. The conductive regions 24 connected to the signal terminals 62 are used to communicate AC signals such as high frequency digital signals between the circuit board 14 and the circuit card 16. The board contacts 92 are transversely offset from the reference terminal board contacts 72 in a staggered pattern (best seen in FIG. 8).

A spring arm 94 extends upward from each of the bodies 86. Each spring arm 94 includes a flexible beam with a vertical portion 96 and an inwardly sloped portion 98. The end of the spring arm 94 includes a lead-in surface 100 and a contact region 102. The two identical signal terminals 62 are loaded into opposite sides of the cavity 46 in reversed positions relative to one another. The two terminals 62 are at opposite sides of the slot 34, and because of the reverse orientation, the two opposed spring arms 94 slope toward one another at opposite sides of the slot 34.

When the mating edge 18 of the circuit card 16 is inserted into the slot 34, an opposed pair of conductive pads 20 enter into each of the cavities 46. The mating edge 18 engages the opposed lead-in surfaces 100 and the spring arms 94 resiliently deflect or separate. When the card 16 is fully inserted, the contact regions 102 engage the pads 20 to complete circuit paths from the terminals 62 to the opposed pair of pads 20. The use of two distinct terminals 62 in each cavity 46 permits independent signal connections to be made to the opposed contact pads 20 at opposite sides of the circuit card 16.

Figure 6:
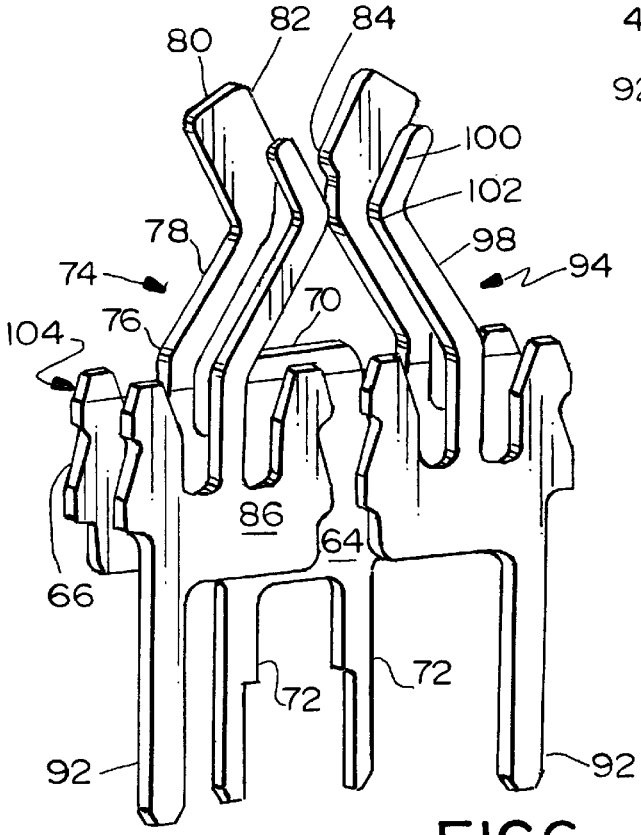
FIG. 6 is an isometric view of a reference terminal and an adjacent pair of signal terminals as they are mounted in the housing of the card edge connector, but with the connector housing removed to reveal the terminals.

Because every signal terminal cavity 46 is immediately adjacent to one of the reference terminal cavities 44, the connector 12 of the present invention includes numerous terminal sets generally designated as 104, each including closely spaced and interfacing reference and signal terminals 60 and 62. One of these many terminal sets 104 is shown in FIG. 6 with the housing 26 omitted to reveal more of the structure of the terminal set. In the preferred embodiment of the invention, each set 104 includes a single reference terminal 60 and an opposed pair of signal terminals 62, but principles of the invention can apply to other arrangements, including where two reference and two signal terminals or one reference and one signal terminal are included in each set. In the preferred embodiment, the reference terminal cavities 44 alternate with the signal terminal cavities 46, but there could be other configurations such as two adjacent signal terminal cavities 44 between each pair of reference terminal cavities.

As seen in FIG. 6, in each terminal set 104 the reference terminal 60 is parallel to and close to the pair of signal terminals 62. The reference terminal 60 substantially entirely overlies or shadows the signal terminals 62. The reference terminal body 64 entirely overlies the signal terminal bodies 86. The reference terminal body is enlarged beyond the extent of the signal terminal bodies 86 by the provision of the central span portion 70 and by downwardly extending the body 64 at the bases of the board contacts 72. The signal terminal inner retention arms 88 are overlaid by the retention arms 66 and by the span portion 70. The signal terminal contact beams 74 are overlaid by the reference terminal contact beams 94 except for the small contact regions 102. This construction provides increased coupling of the signal terminals 62 to the reference terminal 60 and decreases crosstalk between signal paths. The relatively massive structure of the reference terminal 60 reduces inductive impedance.

The enlarged segments 80 of the reference terminal contact arms 74 provide a large surface area overlying the ends of the signal terminal contact arms 94. Because these segments are larger than required for the conventional mechanical and electrical functions of the contact arms 74, they are defined as "oversize". The oversize segments 80 provide several important functions. They increase coupling to the signal terminals 62 without significantly adding mass to functional parts of the terminal and possibly impeding mechanical operation. They provide a sturdy and rugged card lead-in area. The use of numerous such reference terminals 60 all having oversize segments in a symmetrical array at both sides of the circuit card 16 provides increased electrostatic shielding of circuits on both sides of the circuit card 16.

Another advantage of the oversize segments 80 is that the size of the segments 80 can be changed to adjust terminal impedance without interfering with the operation of the terminal. The segments could be reduced in length in accordance with the invention. The resulting terminal would have an impedance different from a terminal as illustrated with larger segments 80. Though other sections of the terminal may need to be correspondingly resized, this feature permits the terminal to be tailored or tuned to specific impedance requirements without interfering with the mechanical function of the terminal.

As can be seen in FIGS. 5 and 6, the reference terminal contact regions 84 are at a higher elevation than the signal terminal contact regions 102. When the mating edge 18 of the circuit card 16 is inserted into the slot 34, it first contacts the reference terminal contact arms 74 and reacts against the lead-in surfaces 82 to resiliently deflect or separate the arms 74. Thereafter, the mating card edge 18 contacts the signal terminal lead-in surfaces 100 and deflects or separates the signal terminal contact arms 94. The peak insertion force is reduced by separating these two contact engagement actions.

The card edge connector 12 of the present invention provides an advantageous array of circuit paths between the circuit board 14 and the terminals 60 and 62. FIG. 8 illustrates a fragmentary portion of the circuit board 14 showing the array of plated through hole conductive regions 24 through which extend board contacts 72 and 92. A reference line 108 identifies the longitudinal centerline of the array, coinciding with the longitudinal centerline of the slot 34 and the center of the inserted circuit card 16. The conductive regions 24 and the board contacts 72 and 92 inserted therein are located in four lines all parallel to the centerline 108, two inner lines 110 and two outer lines 114. The inner lines 110 are closer to the centerline 108 than are the outer lines 114.

The inner lines 110 of conductive regions 24 receive only the contacts of a single type of terminal and the outer lines 114 receive only the contacts of the other type of terminal. In the illustrated arrangement, the inner lines 110 of through holes 24 receive only the reference terminal board contacts 72 and the outer lines 114 receive only signal terminal board contacts 92.

Each terminal board contact 72 is mirrored at an equal distance from the centerline 108 by another reference terminal contact 72. A transverse line 118 intersects two such contacts 72 and illustrates this relationship. Every signal terminal contact 92 is mirrored at an equal distance from the center line 108 by another signal terminal contact 92. Another transverse line 120 intersects two such contacts 92 and illustrates this relationship.

The circuit path array resulting from the present invention can facilitate routing of conductive traces on the circuit board 14 in comparison with conventional asymmetrical circuit arrays. In addition, the symmetrical array is a characteristic of a terminal pattern that facilitates connector manufacture and assembly.

Figure 9:
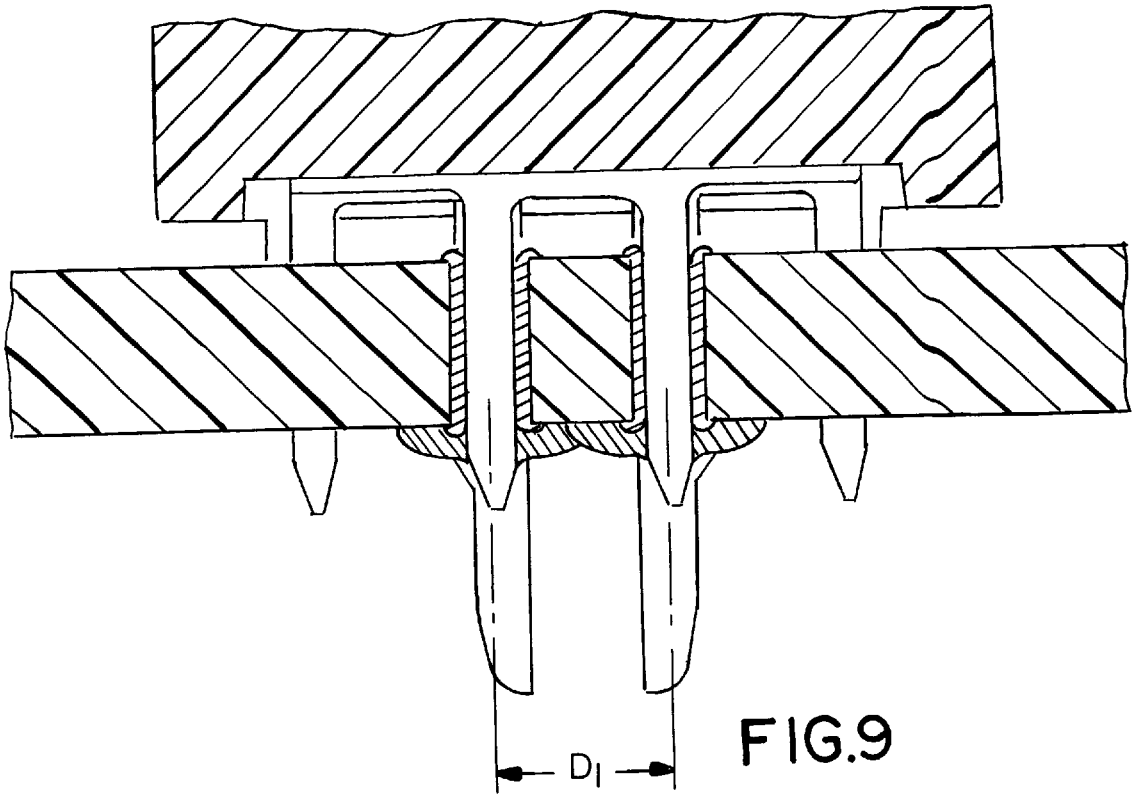
FIG. 9 is a sectional view of a portion of a card edge connector and a reference terminal thereof mounted and soldered to a printed circuit board wherein solder bridging is occurring.

Due to the increasing circuit density of edge card connectors, adjacent through holes and terminal tails in an array may be positioned very closely to one another. Such is the case in the instant invention wherein the symmetric nature of the array with respect to the centerline 108 means that through holes of the inner lines 110 are very near their mirrored through holes directly across the centerline 108. Thus, if ordinarily shaped terminal tails (FIG. 9), are inserted and are soldered therein, it is possible that the resulting solder fillets on the surface of the circuit board may overlap, thereby short circuiting the respective board contacts. While the short circuiting effect may not be particularly problematic when both board contacts extend from the same reference terminal, as they do in the preferred embodiment of the invention, such solder bridging may be perceived to indicate a defective or inferior product.

In order to allay the potential problem of solder bridging, the inventive terminal tails 72 have a full segment 126 extending from the body portion 64 of the reference terminal and a narrowed segment 128 extending from the full segment 126 remotely from the body portion 64 of the reference terminal. In preferred embodiments of the invention, the abutment or transition 130 between the full segment 126 and the narrow segment 128 is formed by a right-angled transition or notch (FIGS. 4–6) or an arcuate transition (FIG. 10) into the width of the tail to remove a vertical portion along one side thereof. More generally, a preferred embodiment is one which leaves a tail of generally gnomon shape.

Importantly, the abutment transition 130 occurs between the top surface 22 and bottom surface 23 of the printed circuit board 14. This ensures that the full segment 126 keeps the board contact 72 spaced centrally within the through hole 22 at the top surface 24 of the printed circuit board 14. In addition, the greater the width of the solder tail, the lower the inductance of the terminal. Meanwhile, the narrowed segment 128 extends through the bottom surface 23 of the printed circuit board 14 and has a centerline which is laterally offset from the centerline of the full segment 126 and through hole 24. Thus, the respective centers of the narrowed segments 128 protruding through the bottom surface 23 of the printed circuit board 14 are further apart than are those of terminal tails not having a narrowed segment such as those shown in FIG. 9. Comparing FIGS. 9 and 10, this feature is illustrated by the fact that D2 is greater than D1. As the respective centers of the tails at the soldering surface (bottom surface 23 in this case) determine the centers of the respective solder fillets 132, the additional spacing of D2 relative to D1 prevents the solder fillets from overlapping and causing a short circuit.

The narrowed segment 128 preferably includes a generally tapered edge wherein the taper is toward the centerline of the full segment 126 as the edge runs more remotely from the body portion of the terminal. Such tapered edges provide misalignment tolerance(s) with respect to inserting the tails into the through holes (mounting the connector onto the circuit board).

As appreciable from the foregoing description, the inventive connector, terminal and tail provide significant advantages over conventional equipment. In particular, the invention provides a high density connector with an advantageous symmetric array of terminals while avoiding solder bridging. The invention is not limited to the embodiment(s) described herein, or to any particular embodiment. Specific examples of alternative embodiments considered to be within the scope of the invention, without limitation, include embodiments wherein the full or narrowed segments of the terminal tails are of unconventional shapes or have curved or rounded edges and wherein an asymmetric array of conductive through hole regions and terminal tails are used. Other modifications to the described embodiment(s) may also be made within the scope of the invention. The invention is defined by the following claims:

We claim:

1. An edge card-type electrical connector for connecting a circuit card having opposed surfaces with conductive pads thereon to a circuit board having top and bottom surfaces and conductive regions on at least one of said top and bottom surfaces, at least one of said conductive regions being a through hole, said connector comprising:

a dielectric housing having a longitudinal slot for receiving said circuit card therein and a plurality of terminal receiving cavities extending perpendicularly to and intersecting said slot;

a conductive signal terminal in one of said terminal receiving cavities, said signal terminal having a body portion, a contact arm extending from said body portion for contacting one of said conductive pads of said circuit card, a retention portion for retaining said terminal in said cavity, and a board contact extending from said body portion to said conductive region of said circuit board; and a conductive reference terminal in another of said terminal receiving cavities, said reference terminal having a body portion, a contact arm extending from said body portion for contacting one of said conductive pads of said circuit card, a retention portion for retaining said terminal in said cavity, and a board contact extending from said body portion to said conductive region of said circuit board;

wherein one of said board contacts of one of said terminals is a through hole-type tail for extending through said through hole, said tail including a full segment and a narrowed segment, said narrowed segment abutting said full segment and extending to a distal end of said tail, each segment having edges and a centerline generally perpendicular to said board, the centerline of said narrowed segment being offset from the centerline of said full segment, said segments abutting between said top and bottom surfaces of said board when said connector is mounted on said circuit board.

2. The connector of claim 1 wherein the end of said narrowed segment remote from said full segment is generally tapered toward said centerline of said full segment to provide a misalignment tolerance as said tail is inserted into said through hole.

3. The connector of claim 1 wherein said reference terminal has at least one contact arm and one board contact on each side of said slot, wherein each of said board contacts of said reference terminal is a through hole-type tail for extending through a corresponding through hole in said circuit board, wherein each of said tails of said reference terminal includes a full segment and an abutting narrowed segment, each segment having edges and a centerline generally perpendicular to said board, the centerline of each narrowed segment being offset from the centerline of each corresponding full segment, a transition between each of said pairs of abutting segments being positioned between said top and bottom surfaces of said board when said tails are extending through said through hole, and wherein said directions of offset of said respective centerlines are generally in opposite directions such that said centerlines of said narrowed segments are further apart than said centerlines of said full segments.

4. A conductive terminal for an edge card-type electrical connector for connecting a circuit card having opposed surfaces with conductive pads thereon to a circuit board having top and bottom surfaces and conductive regions on at least one of said top and bottom surfaces, at least one of said conductive regions being a through hole, said connector including a dielectric housing having a longitudinal slot for receiving said circuit card therein and a plurality of terminal receiving cavities extending perpendicularly to and intersecting said slot, said terminal comprising:

a body portion;

a contact arm extending from said body portion for contacting one of said conductive pads of said circuit card;

a retention portion for retaining said terminal in its respective cavity; and a board contact extending from said body portion to said conductive region of said circuit board;

wherein said board contact of said terminal is a through hole-type tail for extending through said through hole, said tail including a full segment and a narrowed segment, said narrowed segment abutting said full segment and extending to a distal end of said tail, each segment having edges and a centerline generally perpendicular to said board, the centerline of said narrowed segment being offset from the centerline of said full segment, said segments abutting between said top and bottom surfaces of said board when said connector is mounted on said circuit board.

5. The terminal of claim 4 wherein the end of said narrowed segment remote from said full segment is generally tapered toward said centerline of said full segment to provide a misalignment tolerance as said tail is inserted into said through hole.

6. The terminal of claim 4 further comprising a pair of spaced apart contact arms and a pair of spaced apart board contacts, each board contact being a through-hole type tail for extending through corresponding holes in said circuit board, each of said tails including a full segment and an abutting narrowed segment, each segment having edges and a centerline generally perpendicular to said board, the centerline of each narrowed segment being offset from the centerline of each corresponding full segment, a transition between each of said pairs of abutting segments being positioned between said top and bottom surfaces of said board when said tails are extending through said through hole, and wherein said directions of offset of said respective centerlines are generally in opposite directions such that said centerlines, of said narrowed segments are further apart than said centerlines of said full segments.

7. A terminal tail for extending from a terminal and for engaging a through hole in a circuit board having top and bottom surfaces, said tail comprising:

a full segment proximate said terminal, said full segment having a first width; and a narrowed segment extending from said full segment to a distal end of said tail, said narrowed segment being narrower than said first width over the length of said narrowed segment;

wherein when said tail is fully engaged with said through hole, said full segment extends into said through hole from said top surface of said circuit board and said narrowed segment extends from said through hole from said bottom surface of said circuit board.

8. The terminal tail of claim 7 wherein said full and narrowed segments combine to form a generally gnomon shape.

9. The terminal tail of claim 8 wherein said general gnomon shape includes a generally right-angled notch.

10. The terminal tail of claim 8 wherein said general gnomon shapes includes a generally circular notch.

11. The terminal tail of claim 7 wherein the end of said narrowed segment remote from said full segment is generally tapered toward said centerline of said full segment to provide a misalignment tolerance as said tail is inserted into said through hole.

12. An electrical connector for connecting a first electrical component to a circuit member, said circuit member having generally oppositely facing mating and remote surfaces and conductive regions on at least one of said mating and remote surfaces, at least one of said conductive regions being a through hole between said surfaces, said connector comprising:

a dielectric housing having a receiving area for receiving said first electrical component therein and a plurality of terminal receiving cavities extending generally perpendicularly to at least one of said surfaces; and a plurality of conductive terminals, one of said terminals being located in each of said terminal receiving cavities, each said terminal having a body portion, a contact arm extending from said body portion for electrically contacting said first electrical component, a retention portion for retaining said terminal in said cavity, and a board contact extending from said body portion;

wherein said board contact of at least some of said terminals is a through hole-type tail for extending through a respective one of said through holes, said tail including a full segment and a narrowed segment, said narrowed segment abutting said full segment and extending to a distal end of said tail each segment having edges and a centerline generally perpendicular to said mating surface, the centerline of said narrowed segment being offset from the centerline of said full segment, said segments abutting between said mating and remote surfaces of said second electrical component when said connector is mounted to said second electrical component.

13. The connector of claim 12 wherein said full and narrowed segments combine to form a generally gnomon shape.

14. The connector of claim 12 wherein said general gnomon shape includes a generally circular notch.

15. The connector of claim 12 wherein the end of said narrowed segment remote from said full segment is generally tapered toward said centerline of said full segment to provide a misalignment tolerance as said tail is inserted into said through hole.

16. The connector of claim 12 wherein said at least some of said terminals have a pair of spaced apart contact arms and a pair of spaced apart board contacts, wherein each of said board contacts of said terminal is a through hole-type tail for extending through a corresponding through hole in said circuit board, wherein each of said tails of said terminal includes a full segment and an abutting narrowed segment, each segment having edges and a centerline generally perpendicular to said board, the centerline of each narrowed segment being offset from the centerline of each corresponding full segment, a transition between each of said pairs of abutting segments being positioned between said top and bottom surfaces of said board when said tails are extending through said through hole, and wherein said directions of offset of said respective centerlines are generally in opposite directions such that said centerlines of said narrowed segments are further apart than said centerlines of said full segments.

17. A conductive terminal for an electrical connector for connecting a first electrical component to a circuit member, said circuit member having generally oppositely facing mating and remote surfaces and conductive regions on at least one of said surfaces, at least one of said conductive regions being a through hole, said connector including a dielectric housing having a receiving area for receiving said first electrical component therein and a plurality of terminal receiving cavities extending generally perpendicularly to at least one of said surfaces, said terminal comprising:

a body portion;

a contact arm extending from said body portion for contacting said first electrical component;

a retention portion for retaining said terminal in its respective cavity; and a board contact extending from said body portion;

wherein said board contact of said terminal is a through hole-type tail for extending through said through hole, said tail including a full segment and a narrowed segment, said narrowed segment abutting said full segment and extending to a distal end of said tail each segment having edges and a centerline generally perpendicular to said mating surface, the centerline of said narrowed segment being offset from the centerline of said full segment, said segments abutting between said mating and remote surfaces of said circuit member when said terminal is mounted to said circuit member.

18. The terminal of claim 17 wherein said full and narrowed segments combine to form a generally gnomon shape.

19. The terminal of claim 17 wherein said general gnomon shape includes a generally circular notch.

20. The terminal of claim 17 wherein the end of said narrowed segment remote from said full segment is generally tapered toward said centerline of said full segment to provide a misalignment tolerance as said tail is inserted into said through hole.

21. The terminal of claim 17 further comprising a pair of spaced apart contact arms and a pair of spaced apart board contacts, each board contact being a through hole-type tail for extending through a corresponding through hole in said circuit board, each of said tails including a full segment and an abutting narrowed segment, each segment having edges and a centerline generally perpendicular to said board, the centerlines of each narrowed segment being offset from the centerlines of each corresponding full segment, a transition between each of said pairs of abutting segments being positioned between said top and bottom surfaces of said board when said tails are extending through said through hole, and wherein said directions of offset of said respective centerlines are generally in opposite directions such that said centerlines of said narrowed segments are further apart than said centerlines of said full segments.

* * * * *